United States Patent [19]

Mardine et al.

[11] 3,959,111

[45] May 25, 1976

[54] ELECTROLYTIC CELL

[75] Inventors: Pierre Mardine, Saint Gratien; Lucien Allais, Marly-le-Roy, both of France

[73] Assignee: Le Nickel, Paris Cedex, France

[22] Filed: Aug. 14, 1974

[21] Appl. No.: 497,476

[30] Foreign Application Priority Data

Aug. 16, 1973 France ..... 73.29904

[52] U.S. Cl. ..... 204/258; 204/265; 204/266; 204/286

[51] Int. Cl.[2] ..... C25C 1/08; C25C 7/00; C25B 1/26

[58] Field of Search ..... 204/258, 265, 266, 286

[56] References Cited

UNITED STATES PATENTS

| | | | |
|---|---|---|---|
| 1,365,033 | 1/1921 | Greenawalt | 204/286 X |
| 2,691,628 | 10/1954 | Aannerud | 204/258 X |
| 3,537,961 | 11/1970 | White et al. | 204/266 X |

FOREIGN PATENTS OR APPLICATIONS

| | | | |
|---|---|---|---|
| 543,294 | 2/1942 | United Kingdom | 204/258 |

*Primary Examiner*—John H. Mack
*Assistant Examiner*—A. C. Prescott
*Attorney, Agent, or Firm*—Fleit & Jacobson

[57] ABSTRACT

A cell for producing metal by electrolysis of aqueous solutions of the relevant chloride comprises at least one electrolytic tank having upright cathodes and upright insoluble anodes alternating in the longitudinal direction of the tank, each anode being surrounded by an anodic box whose sides which face cathodes each comprise a diaphragm, the cell further comprising means of collecting and recovering the chlorine released during electrolysis, means of drawing off vapor generated at the surface of the electrolyte, means of blowing gas into the bottom of the tank below each cathode, and rack-mounted U-shaped guide-rail locating means for use in placing and for retaining in position the cathodes, the anodes and the anodic boxes.

20 Claims, 7 Drawing Figures

32
42
39
47b
43
34
37
35
33b
4b
31
30
40
47a
36
33a
4a

ELECTROLYTIC CELL

FIELD OF THE INVENTION

The present invention relates to an improved cell for electrolysis of aqueous solutions of metal chlorides with insoluble anodes, this cell being more particularly suitable for the production of pure nickel from solutions of nickel chloride.

DESCRIPTION OF THE PRIOR ART

Cells are already known which comprise an electrolyte tank equipped with electric current supply means, alternate vertically extending anodes and cathodes spaced along the longitudinal axis of the tank. A box is provided around each anode together with means of feeding fresh electrolyte into the tank and of eliminating spent electrolyte. A known such box is a parallelepiped and in its two largest parallel surfaces has openings over which are stretched cloths acting as diaphragms. During electrolysis of metallic chloride(s), gaseous chlorine is released at the anodes, whilst the metal(s) are deposited on the cathodes.

Such cells have apparently not enjoyed great industrial success, and it is pertinent to quote U.S. Pat. No. 2,578,839, which specifies some disadvantages of these devices as follows:

"Attempts have been made heretofore to operate cells producing nickel at the cathode and chlorine at the anode, but such attempts have been unsuccessful due to difficulties encountered in handling the chlorine. Furthermore, to provide adequate cathode efficiency for economical operation, it has been found necessary to use either cathode or anode diaphragms to prevent a large percentage of the current from being utilized for hydrogen ion discharge and chlorine reduction. Any such diaphragm arrangements, suitable for nickel electro-refining, have, however, been found to deteriorate rapidly due to the action of molecular chlorine, resulting in numerous chlorine leaks necessitating frequent changes of diaphragms and tank linings. Even more objectionable than the hereinbefore mentioned difficulties has been the resulting addition of chlorinated, water soluble, organic compounds to the nickel electrolyte which resulted in production of strained, warped cathodes throughout the tank house."

The aforesaid patent proposes to resolve some of these problems by suppressing the release of gaseous chlorine by using an anolyte different from the catholyte, an intermediate compartment being situated between each cathodic compartment and the adjacent anodic compartments.

This cell has drawbacks, especially that the presence of intermediate compartments enforces an increase in the distance between the electrodes, which causes the consumption of electric power to increase in view of the increased resistivity of the cell.

OBJECTS OF THE INVENTION

It is thus one of the objects of the present invention to provide an electrolytic cell which is free of chlorine leaks and vapours passing into the surrounding atmosphere, and which would therefore not expose personnel to danger.

Another object of the invention is to provide a cell of satisfactory electrical efficiency.

A further object is to provide a cell in which the cathodes and anodes can easily be placed in position and removed without, in the latter case, interfering with the anodic boxes and without running the risk of altering the position of the electrodes during handling operations.

It is a further object that metal deposits produced by the cell at the cathodes should have a surface condition of constant and satisfactory quality.

It is a further object that the cell should be simple to use industrially and to be of uncomplicated, robust and relatively inexpensive construction.

SUMMARY OF THE INVENTION

Despite appearances, the above objects are not unconnected, as will be explained.

In accordance with the invention, there is provided a cell for producing metal by electrolysis of aqueous solutions of the relevant chloride, comprising at least one electrolytic tank having upright cathodes and upright insoluble anodes alternating in the longitudinal direction of the tank, each anode being surrounded by an anodic box whose sides which face cathodes each comprise a diaphragm (e.g. cloth), the cell further comprising means of collecting and recovering the chlorine released during electrolysis, means of drawing off vapour generated at the surface of the electrolyte, means of blowing gas into the bottom of the tank below each cathode, and locating means for use in placing and for retaining in position the cathodes, the anodes and the anodic boxes.

It is the combination of these means which can render it possible to accomplish the objects pursued, especially the industrial production of a product of good quality, without danger to the personnel and with satisfactorily low power consumption. For example, blowing a gas into the bottom of the tank can result in a remarkably smooth surface condition on the cathodes, as is desired. This result enables the cathodes to be brought closer to the adjacent anodes, thus reducing the electric power wasted by the resistivity of the bath, another desideratum. The problem of accurate placement of the electrodes is however then encountered, imposing the need to incorporate locating means for placing and retaining them in position in precise manner; solving this problem can assist the convenient industrial use and robust construction of the cell, and so on for the other desiderata.

The means specified in the foregoing for collecting and recovering the chlorine released during electrolysis preferably comprises a hermetic anodic bell capping each said anodic box and having its lower edges below the intended electrolyte level, a longitudinally extending trough fixed to the bath and in communication therewith below the intended electrolyte level, a chlorine collector pipe running along the said trough, feed tube means communicating with the pipe and with the inside of each said anodic bells above the intended electrolyte level, the collector pipe being connectable to suction means for recovering the chlorine released.

It will be grasped that the anodic bells form hydraulic keepers and that the chlorine cannot escape except through the feed tube means (which are preferably vertical pipes) where it is recovered through the chlorine collector pipe. Compared with the proposals in United States Patent 2,578,839, where efforts were made to prevent any release of molecular chlorine, it is here possible to recover the chlorine in gaseous form. The recovery operation is advantageous in view of the commercial value of chlorine, which may moreover be converted easily into hydrochloric acid, this latter being used to produce the chlorides which are subjected to electrolysis in the cell.

For preference, the means of drawing off vapour generated at the surface of the electrolyte comprise a longitudinally extending purification sheath fixed to the tank and in communication therewith above the intended electrolyte level, means of drawing off by suction and recovering the contents of the said sheath, and transversely extending flexible strips which co-operate hermetically to cover the tank, including said trough and the purification sheath.

This purification device offers the advantage of using much less power than the known devices of the same nature, in particular thanks to the presence of the flexible sealing strips which may be joined together or, better still, overlap each other.

In particularly advantageous embodiments of the invention, each transverse strip is fixed to an anode, and the cell comprises a plurality of at least partially screw-threaded rods secured to the upper part of each said anode, to each said rod there being bolted upwards from below, for each anode, its anodic bell and one of the transversely extending flexible strips, the rods being connected at their upper extremities to a carrying bar common *only* to *all* the screw-threaded rods of *one* anode.

In an advantageous arrangement, the trough and the purification sheath share a longitudinally extending lateral partition and are fixed to the exterior of the tank, the partition permitting communication between the trough and the sheath but only above the intended electrolyte level. The vapour can then pass through the chlorine discharge trough before reaching the purification duct, from which it is drawn off by suction.

Preferably, the means specified above for blowing gas (which may be one gas or a mixture of gases) into the bottom of the bath comprise a many-holed distributor vertically below each cathode and having the shape of a shallow Vee, each vee being connected at its vertex to a common longitudinal pipe connectable to means of injecting at least one gas under pressure into the pipe.

Unexpectedly, it was discovered that the efficiency of this gas purification device is highest if the diameter of the holes of the distributors is very small, preferably 0.1 to 0.5 mm. e.g. 0.3 mm. Moreover, it is advantageous if the holes of each distributor are situated in two rows at either side of the vertical symmetry plane of the distributor. On each of the limbs of the Vee formed by one of the distributors, the rows of holes are preferably situated on two generatrixes at preferably approximately 45° from the top generatrix, at either side of the symmetry plane (the plane containing the vee) of the distributor.

In an advantageous arrangement, the gas insufflation distributors are stationarily installed on longitudinal sections removably tethered to longitudinal fins upstanding in the bottom of the tank.

These arrangements engender a rising gas flow along the cathodes and, consequently, an effective sweeping of the cathodes by the electrolyte. Also, homogenisation is ensured of the contents of the cell (including recently-added substances, for example, solutions of chlorides intended to regenerate the bath, or elase a variety of additives).

These arrangement can equally reduce the contents of occluded gases in the bath, and a deposit displaying an excellent surface condition is then obtained on the cathodes. As a result of this, it is then possible to bring the electrodes closer to each other, which theoretically renders it possible to reduce the electric power consumption caused by the resistivity of the bath, if the practical problem is solved of locating and keeping the cathodes, the anodes and the anodic boxes in position in precise manner, whilst being able to withdraw them from and replace them in the bath easily.

The means incorporated for this purpose preferably comprise, for each anode, a pair of transversely spaced vertically extending guide rails each guide rail being generally U-shaped in plan, the U being open towards the respective nearer side of the bath and whereof the base of the U has a recess the opposite sides of which anodic box of the anode in question, the vertical edges of the cathodes being mounted in an electrically insulating edging or frame secured against longitudinal movement by respective limbs of the U of two consecutive guide rails between which the cathode is; the two vertical guiding rails may be installed symmetrically at either side of the bath. Each of these guiding rails may be considered to have a rack section grasping the anodic box by its sides.

Moreover, it is advantageous if the said limbs of the U of the guide rails extend vertically above the top of the base of the U and are of inwardly bent configuration to provide sloping guide surfaces for dropping a cathode in place. The purpose of these sloping guide surface or vanes is to ease the insertion into the bath of the cathodes, which are preferably equipped with an insulating edging or frame, for example of wood or rubber or plastics material, at least on their three sides which come into contact with the electrolyte.

For the purpose of keeping the anodic boxes in position, the locating means preferably comprises two smaller and two larger gripping clamps, all of generally J-shaped profile, the extremity of the longer limb of each J being of bent configuration for gripping, respectively, the shorter and the longer upper edges of the anodic box, of the anode in question, these clamps being fixable to the tank. For each anodic box, the cloth acting as a diaphragm may then be clamped to the upper edges of the box by means of the said outwardly bent extremity of the longer limb of the J.

Preferably there are, further, two laterally spaced and longitudinally extending racks having rectangular teeth whereof the pitch is equal to the distance between two consecutive anodes. This distance is of course the same as the distance between two consecutive cathodes.

Preferably the two smaller gripping clamps of each anodic box are bolted, with optional interposition of a spacer, to one of a respective laterally aligned pair of teeth of the racks.

In advatageous embodiments, the guide rails are equipped with fastening lugs at the top and bottom. The lower lugs of the two guiding rails of one and the same anodic box may then be joined in unit with a transverse plate installed on the bottom of the anodic box. The smaller gripping clamps would be bolted to the upper lug. Moreover, the larger gripping clamps of each anodic box can be situated at either side of the tank, in two consecutive notches of the corresponding rack.

At their lower part, the anodes and the anodic boxes are kept in position preferably by means of centring devices which, for each anode and in its vertical symmetry plane, comprise two preferably vertical or upright centring pins possibly symmetrical with respect to the axis of the bath and fixed thereto, the bottom of the corresponding anodic box having two orifices which may be traversed by the centring pins upon placing the box in position; the bottom of each anode may have two blind holes to engage over or cap these centring pins.

The two orifices in the bottom of each anodic box may each be equipped with a sleeve wherein may slide a corresponding centring pin, this sleeve comprising a head or flange at its lower extremity and a screw-threaded portion at its upper extremity, over which is threaded a nut which, between the head of the sleeve and the bottom of the anodic box, grips the transverse plate referred to in the foregoing and whereon may be bolted, by means of their low fastening lugs, the guiding rails of the electrodes.

The most preferred locating arrangement performs three separate but complementary functions:

1. upon placing an anode in position, the centring pins engage the blind holes at the lower part of the anode to hold the anode removably in position, thus easily rendering it possible to withdraw the anodes and to place them in accurate position again without interfering with the anodic boxes;

2. upon installing an anodic box, which as known occurs very infrequently only, the sleeves secured to the bottom of the box slide in an easy fit on the rod of the centring pins and co-operate with these latter to hold the box in position, without the need to dismantle anything at the bottom of the tank; and components requiring to be dismantled can all be situated at the upper (more accessible) part of the tank.

3. upon removing an anodic box, the electrolyte it contains would conventionally flow out through the diaphragms, which is protracted and could damage the cloths. In the preferred device in accordance with the invention, the electrolyte can flow out through the axial bores of the sleeves installed at the bottom of the box.

The cell may be contemplated by two lower longitudinal racks secured to the bottom of the bath, being racks whereof the crenels receive the lower edges of the cathodes.

Throughout the foregoing, the term "electrolytic cell" has been used assuming that each coil comprises no more than a single tank. However, it is appropriate to ascribe to the term "cell" its wider significance of an industrial electrolysis unit which may comprise two or more tanks identical or analogous to the cell described.

An electrolysis unit of this kind will preferably comprise two symmetrical tanks positioned in parallel side-by-side. These tanks would be serviced by a variety of shared devices, for example such as the means of discharging and recovering the chlorine or the means of drawing off the vapour generated at the surface of the tanks.

The invention extends to a metal (such as nickel), when produced by electrolysis of an aqueous solution of its chloride in a cell as set forth above.

BRIEF DESCRIPTION OF THE DRAWINGS

The invention will now be described by way of example with reference to the accompanying figures, in which.

DETAILED DESCRIPTION OF PREFERRED EMBODIMENT

As has been stated in the foregoing, the electrolysis cell in accordance with the invention may comprise several identical or symmetrical tanks and the following description will relate solely to one of these tanks.

Figure 1:
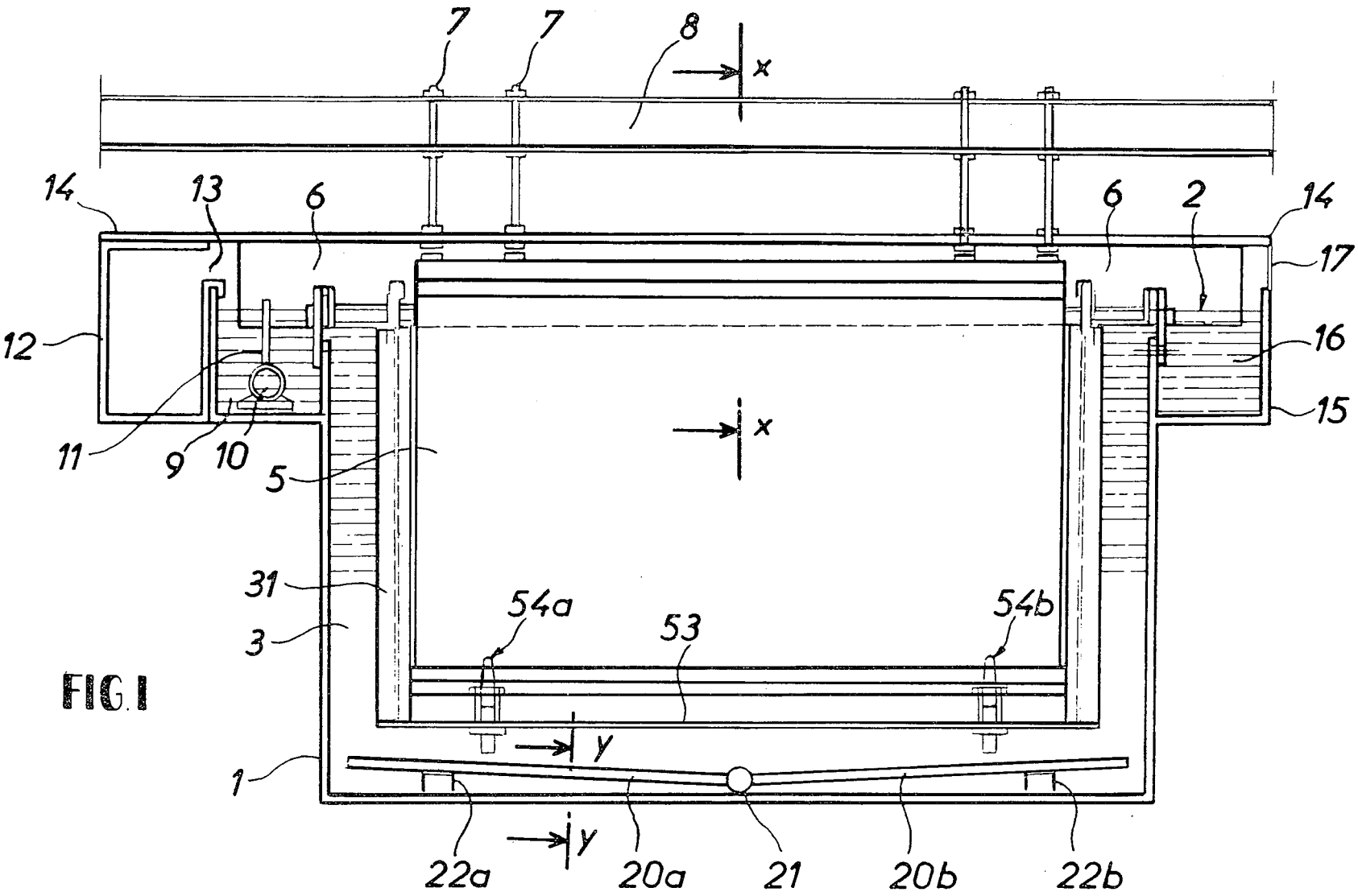
FIG. 1 is a diagrammatical vertical cross-section of a single-tank electrolysis cell in accordance with the invention.

As apparent from FIG. 1, an electrolyte tank of a cell in accordance with the present invention comprises a parallelpipedal container 1 filled by a level 2 with an electrolyte 3 comprising an aqueous solution of the chloride(s) of metal(s) to be deposited on cathodes of the cell plane parallel to the planes of the electrodes.

Generally planar cathodes 4 (not shown in FIG. 1) and anodes 5 extend vertically in the tank and extend parallel to each other and to the small sides of the parallelpipedal container 1. The term "longitudinal" will henceforth be applied to the direction at right angles to the planes of the cathodes and anodes, and the term "transverse" to any direction within or parallel to the planes of the cathodes and the anodes.

The cathodes and the anodes alternate; thus each cathode is positioned between two anodes, the last electrode at each end of the tank being an anode.

A cell capable of passing approximately 30,000 Amperes might comprise two symmetrical tanks of which each contains 30 cathodes and 31 anodes and whereof each measures about 1 m horizontally transversely, 1.3 m in height and 4.7 m longitudinally.

Figure 2:
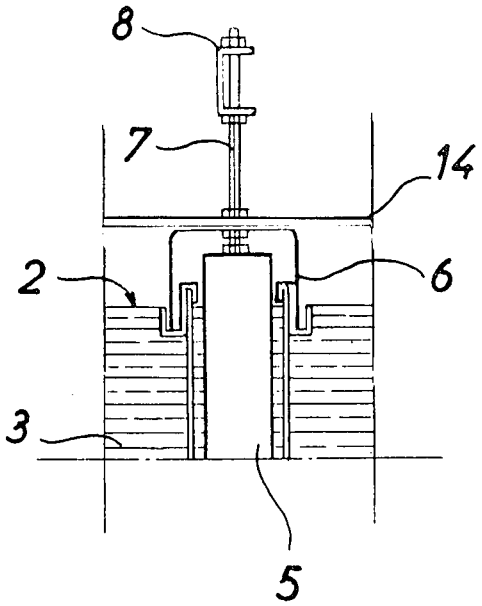
FIG. 2 is a partial cross-section view taken along the line X—X of FIG. 1.

A device for collection of chlorine in an electrolysis cell in accordance with the invention will now be described. As apparent from FIGS. 1 and 2, each anode 5 is covered over its entire upper part by a hermetic anodic bell 6 of inverted-U cross-section. Four partially screw-threaded vertical rods 7 are fixed in and project upwards from the anode 5. The rods pass through the base of the bell 6, to which they are joined by nuts. At their upper extremities, the four rods 7 of the one anode 5 are secured on a transverse carrying bar 8 connected to a frame which is not illustrated. The lower edges of the bells 6 come below the level 2 of the electrolyte 3, which establishes a hydraulic seal against the escape of chlorine to the outside. Each anode is likewise equipped.

To discharge chlorine released during electrolysis and accumulated in the bells 6, the bells (see FIG. 1) extend transversely beyond one vertical side of the container 1 and here their lower edges are immersed in electrolyte retained in a longitudinal trough 9 in communication with the inside of the tank, so that the levels of the electrolyte are the same. A chlorine collector pipe 10 runs the length of the bottom of the trough 9, and level with each anode is equipped with a vertical tube 11 connecting the inside of the pipe 10 to the base of the bell 6. The chlorine can leave the bells 6 only through the vertical tubes 11 to flow towards the collector pipe 10 from which it may be removed by any appropriate means.

The tank also comprises a device for purification and for vapour extraction (independent of the chlorine collector just described) for extracting the vapour released at the surface of the electrolysis bath as a consequence of its high temperature (for example 80°C to 110°C). Although this vapour is less harmful than chlorine, it is desirable nevertheless to prevent its escape.

The purification and vapour extraction device comprises a sheath 12 connected to a suction device (not illustrated) and joined throughout its length to the trough 9. Thus although outside the tank 1, the sheath 12 is connected thereto by a longitudinal passage 13 above the partition common to the purification sheath 12 and the trough 9. The upper edge of this common practice is above the level 2 to prevent entry of the electrolyte 3.

Horizontal transverse strips 14 of pliable material (preferably rubber) completely cover the container 1 and the purification sheath 12. Each of these strips is joined to an anode and every other strip overlaps its two adjacent strips over a small width (longitudinally). This may be obtained simply in the following manner: when the anodes are being placed in position, the odd-numbered ones are lowered into the tank first, so that the flexible strips of the even-numbered anodes will then overlap the others.

The strips 14 extend transversely at one side as far as required for completely covering the top of the purification sheath 12 and, at the other side up to vertically above the outer side 15 of a longitudinal overflow 16 which runs along the side of the container 1 throughout its length, and into which surplus electrolyte overflows. The side 15 of the overflow 16 carries upright supporting rods 17 of synthetic material bearing the flexible strips 14.

This purification and vapour extraction device works by generating low pressure within the sheath 12 by the suction device, to draw ambient air through the spaces between the rods 17. This air sweeps the surface of the electrolyte whilst entraining the vapour which is thus carried past the upper part of the trough 9 and discharged through the sheath 12.

This arrangement saves considerable power compared with known devices wherein air under pressure is blown in at the surface of the tank to discharge the vapour released during electrolysis.

The tank comprises a conventional device for infeed of fresh electrolysis, therefore neither described nor illustrated herein.

The tank further comprises a device for blowing air or an appropriately selected gas (or mixture of gases) into the electrolyte below each cathode.

As seen in FIG. 1, in the bottom of the tank there is an insufflation distributor below each cathode and in the vertical plane of this latter. Each distributor comprises two tubes 20*a*, 20*b*, installed in the form of a very shallow vee fed by a common longitudinal pipe 21 which is positioned centrally and longitudinally of the container 1. The extremities of the tubes 20*a*, 20*b* are closed off, and the tubes are affixed, for example by welding, on longitudinal U-sections 22*a* and 22*b* common to all the insufflation distributors and joined to the bottom of the container 1 by means illustrated in greater detail in FIG. 3.

Figure 3:
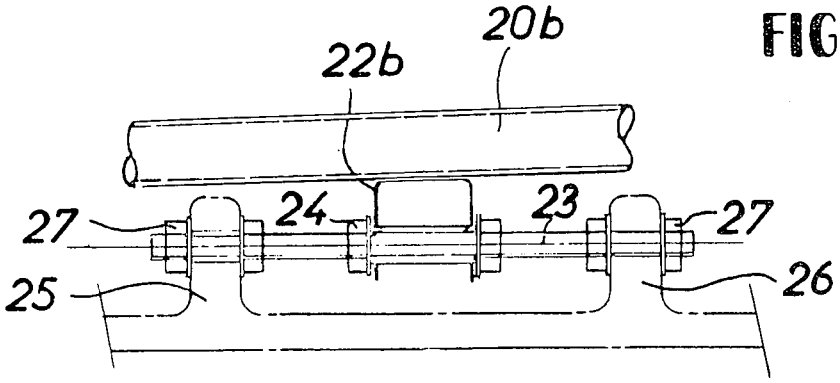
FIG. 3 in more detailed manner illustrates the part of FIG. 1 which applies to the fastening of the insufflation distributors within the cell.

FIG. 3 shows solely a tube 20*b*, the fastening elements of the corresponding tube 20*a* being understood to be symmetrical to those of the tube 20*b*. The section 22 of inverted U-shape has its web welded to the tube 20*b* and its flanges are traversed by a screw-threaded rod 23 immobilised on the section 22*b* by means of two bolts nuts 24. Close to its two extremities, the rod 23 traverses two upstanding longitudinal fins 25 and 26 formed in the bottom of the container 1. Nuts 27 on the rod 23 clamp each fin 25, 26, and prevent any transverse displacement of the insufflation distributor.

Figure 4:
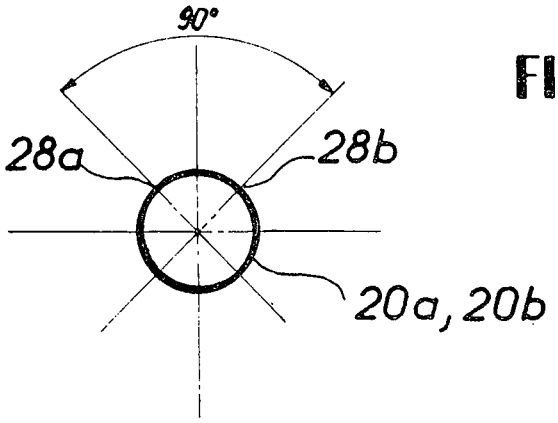
FIG. 4 is a partial cross-section taken along the line Y—Y of FIG. 1.

The tubes 20*a*, 20*b* of each distributor are each equipped with two rows 28*a*, 28*b* of holes (identical for 20*a* and 20*b*) whereof the arrangement is depicted by the cross-section of FIG. 4. The rows 28*a*, 28*b* are circumferentially 90° apart, face generally upwardly and are symmetrical with respect to the vertical.

It has been discovered, rather unexpectedly, that the diameter of these holes has for good results to be very small, of the order of 0.3 mm for example.

Effective sweeping of the cathodes by the electrolyte, as well as a homogenisation of the contents of the cell and a reduction of the proportion of occluded gases, are obtained by use of the insufflation distributor described. These factors result in a remarkably smooth surface condition of the metal deposited on the cathodes and it is then possible to adopt a rather small inter-electrodes spacing, and this lowers the electric power dissipated by the resistivity of the electrolyte.

A small spacing between the cathodes and anodes imposes the need to ensure precise positioning of the electrodes and the arrangements applied for this purpose will now be described.

As mentioned above, the cathodes 4 and the anodes 5 alternate and the anodes (whilst in the operating position) are surrounded by boxes 6 whereof the large surfaces comprise a cloth acting as a diaphragm. The anodes 5 and the boxes 6 remain in the tank for protracted periods, since the anodes are insoluble and are withdrawn only for repairs, whereas the cathodes are frequently withdrawn from the tank and placed in position again, since they are removed from the tank as soon as the electrolytic deposit is worth collecting.

Figure 5:
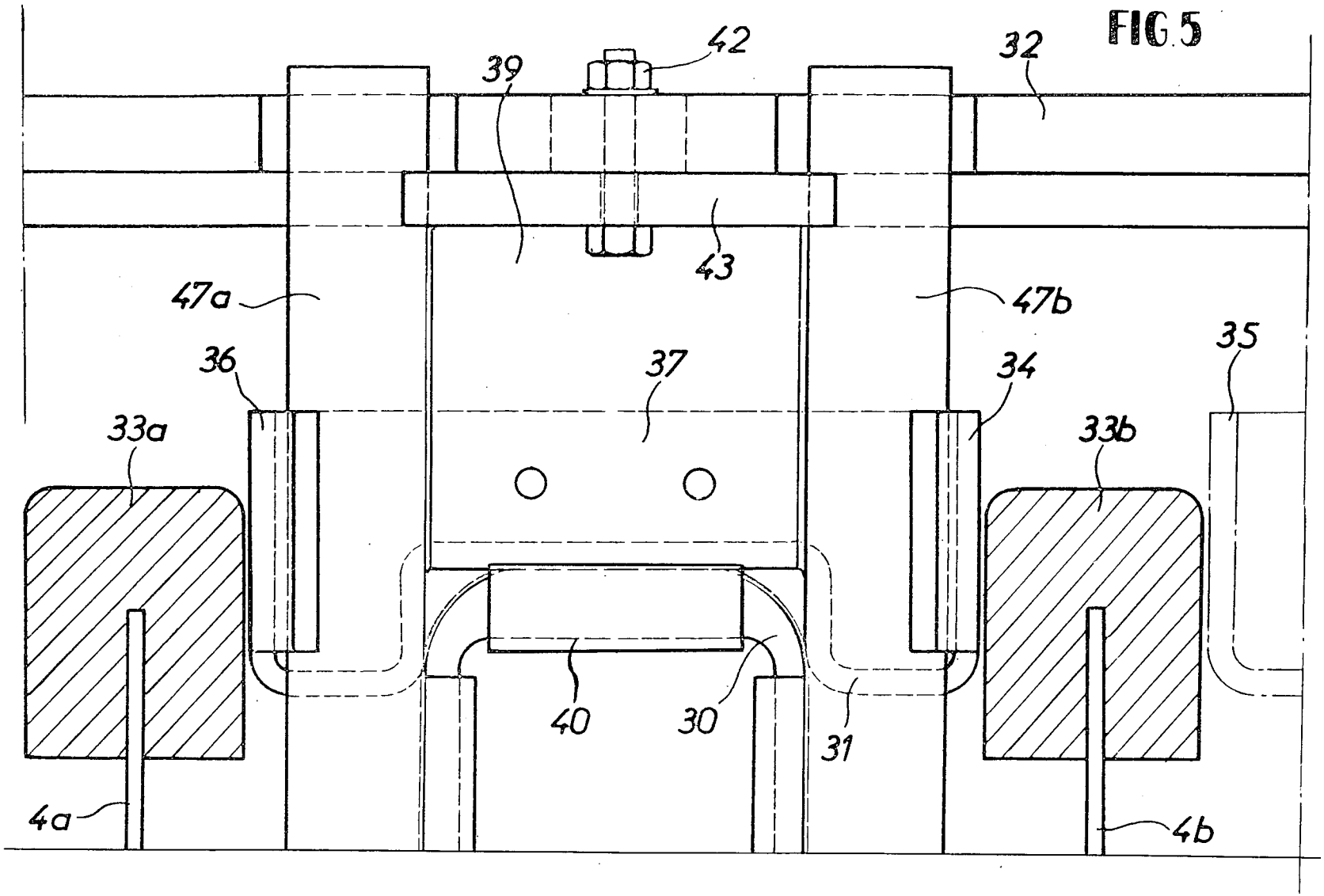
FIG. 5 is a sketch in plan of devices for holding the cathodes and the anodic boxes in position within the cell.

FIG. 5 is an extremely diagrammatical plan view of a side of the tank with two cathodes 4*a*, 4*b* flanking an anodic box 30 whereof the anode has not been illustrated.

At either side of the tank, the essential elements for centring and securing in position the cathodes and the anodic boxes comprise a vertically extending guiding rail 31 of generally U-shaped plan for each anode and a longitudinal rack 32 extending throughout the length of the container 1, to which it is fastened by bolts (not illustrated). This rack 32 has rectangular teeth of pitch equal to the distance between consecutive anodes. This distance also equals the distance between consecutive cathodes, since all the electrodes are spaced apart evenly, be they anodes or cathodes.

The rail 31 has the general plan of a very shallow U open towards the tank wall side. The base of the U comprises a recess the sides of which, throughout their height, clamp the vertical edge of the anodic box 30, which is joined to the two corresponding guiding rails by means to be described. The means whereby the anodic box 30 is connected to the container 1, will also be described later.

The cathodes 4*a*, 4*b*, . . . are equipped, at least on the three edges immersed in the electrolyte 3, with an insulating frame 33*a*, 33*b*, for example of wood, rubber or plastics, for preventing metal from being deposited on the periphery of the cathodes, whence its removal would be difficult. The vertical side of the frame 33*b* is held in position by means of a flange 34 of the guiding rail of the next anode, and likewise for the frame 33*a* of the cathode 4*a*, held between the other lateral flange 36 of the rail 31 and the flange (not shown) of the preceding guiding rail.

The anodic box 30 (FIG. 6 — lower part) is housed within the wide notch in the guiding rail 31, which notch has an upper horizontal fastening lug 37 also visible in FIG. 5.

Figure 6:
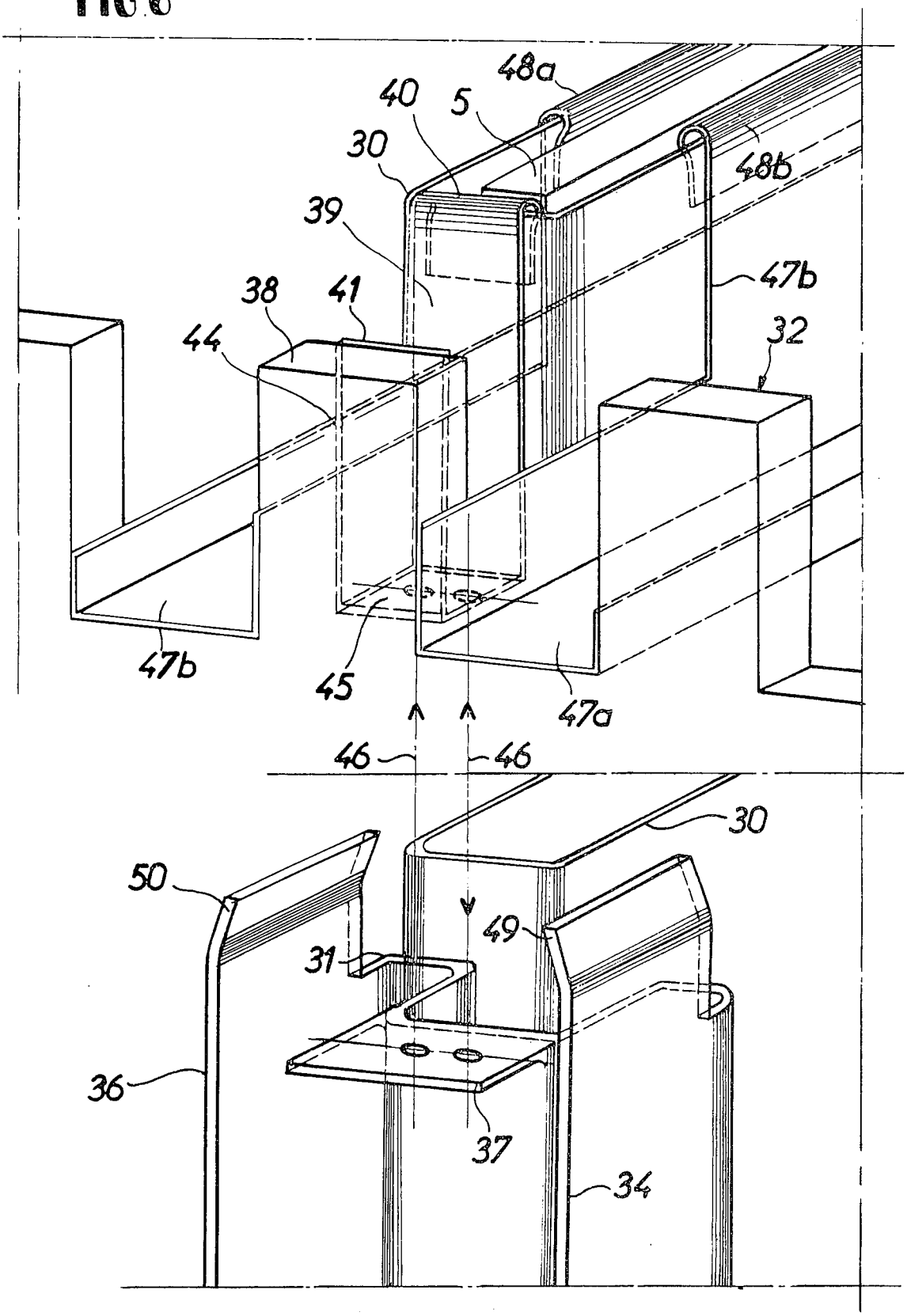
FIG. 6 is a diagrammatic perspective view of the devices of FIG. 5.

The upper part of FIG. 6 shows the top portion of the same anodic box 30, the corresponding anode 5 and the corresponding tooth 38 of the rack 32. A small generally J-shaped clamp 39 is bent over outwardly at the extremity 40 of its lower limb, to clamp the upper edge of the smaller side of the anodic box 30.

The other limb 41 of the clamp 39 is secured by a bolt 42 (FIG. 5) (the bolt 42 having an axis 44) on the inner surface of the tooth 38 of the rack 32, with interposition of a spacer 43. The bottom 45 of the clamp 39 is bolted on the horizontal lug 37 of the guiding rail 31, conveniently depicted in FIG. 6 by arrows 46. For clarity, FIG. 6 is not strictly to scale and it will be appreciated that, for example, when the assembly is installed, the top of the anodic box 30 as illustrated in the lower portion of the figure is situated at the position of the top of the box depicted in the upper portion.

The fastening of the anodic box 30 is completed by means of two large transversely extending clamps 47*a*, 47*b* which are also J-shaped. The longer limb of the J, as in the case of the clamps 39, comprises a bent-over portion 48*a* and 48*b* as the case may be, which clamps the upper edge of the anodic box 30, but at its larger side in this case.

Each of the large clamps 47*a*, 47*b* extends outwards at its lower part for insertion into a respective one of the two notches of the rack 32 flanking the tooth 38.

Finally, the flanges 34 and 36 of the guiding rail 31 have upwardly extending slightly inwardly bent guide surfaces 49 and 50, to facilitate placing the cathodes between respective pairs of consecutive guiding rails.

As has been mentioned above, each anodic box 30 is covered by a cloth acting as a diaphragm. When the box is placed in position of the box, the cloth should be stretched and its edges folded inwards over the upper periphery of the box. It is then sufficient to install the small and large clamps for the cloth to remain appropriately tensioned. Bolts (not illustrated) are then inserted through the corresponding extremities 40 and 48 of the clamps, to secure the whole.

At the other side of the bath, the device (not illustrated) for placing and holding the cathodes and anodic boxes in position is symmetrical to that which has been described.

Figure 7:
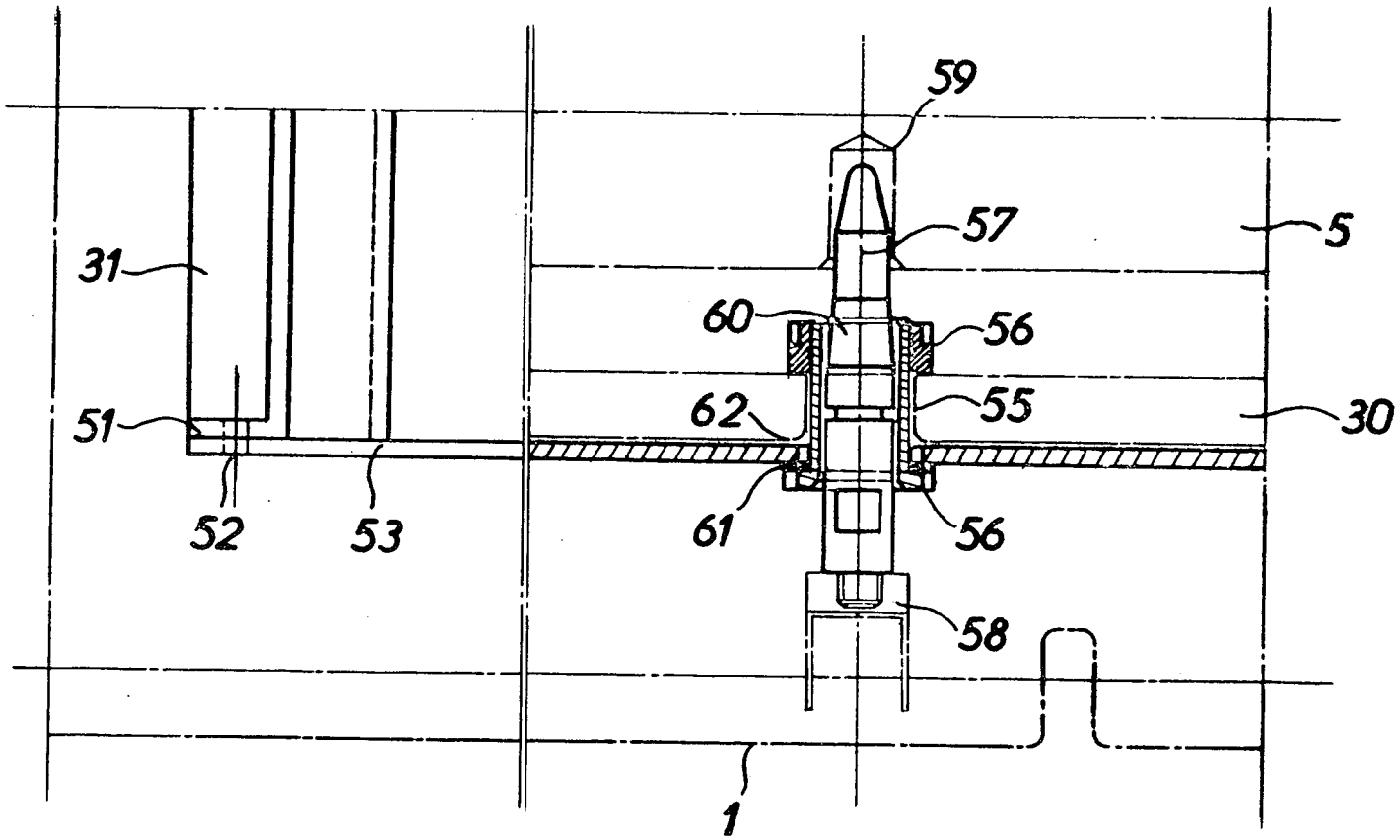
FIG. 7 is a plan of a centring stud for an anodic box within the cell.

FIG. 7 shows the lower part of the container 1, with an anode 5, the corresponding anodic box 30 and the lower portions of the guiding rail 31, which at its base has a horizontal fastening lug 51 below which is bolted at 52 a transverse plate 53 installed likewise on the symmetrical guiding rail (not illustrated) at the other side of the container 1.

Returning to the lower part of FIG. 1 two centring elements 54*a* and 54*b* on the plate 53 are symmetrical with respect to the central vertical plane $x - x$ of the tank, so only one of the two has been illustrated in detail in FIG. 7.

The transverse plate 53 is placed on the lower surface of the anodic box 30 and a cylindrical sleeve 55 traverses the plate 53 and the bottom of the box 30. At its lower part, this sleeve 55 has a flange engageable with a tool for rotating it, and its upper part is screw-threaded and bears a threaded nut 56 which removably joins the sleeve 55, the plate 53 and the anodic box 30.

A vertical centring pin 57 is screwed into a longitudinal section 58 which is fixed to the bottom of the container 1. The pin 57 is a rather loose fit in the axial bore of the sleeve 55 and terminates in a rounded tip which enters a blind hole 59 formed in the base of the anode 5. The centring pin 57, near its middle, has a frustoconical bearing surface 60 to facilitate the insertion of this pin into the sleeve 55 while permitting accurate location. Sealing washers are installed around the sleeve 55, one (61) between the head 56 of the sleeve and the plate 53, and the other (62) between this plate and the lower side of the anodic box 30.

In operation, when the anodic box 30 is being placed in position, the sleeve 55 is passed over the stationary pin 57 and is thus centered automatically whilst centering the anodic box in unit with it, under co-operation with the identical sleeve at the other side of the tank. Analogously, the anode 5 is centred on the two stationary pins by means of the blind holes 59.

Moreover, upon withdrawing the anodic box 30 from the container 1, the electrolyte it contains can flow out through the bores of the sleeves 55 which are vacated by the pins 57. This prevents the difficulties, such as slow draining and the risk of damaging the cloth, which would be encountered if the electrolyte were to be unable to escape except through the cloth acting as a diaphragm.

The tank may comprise, on the inner surface of each of its longitudinal sides, a lower rack (not illustrated). The notches therein would then receive the bottom of the frames 33 (see FIG. 5) which surround the cathodes, to hold these in position. The anodes and cathodes are connected electrically to respective terminals (not illustrated), which may be conventional.

The materials used for the various components of a cell in accordance with the invention should be selected having regard to the particular electrolyte envisaged. The cathodes may thus, for example, consist of stainless steel, titanium, aluminium or the same metal as the cell is intended to produce. The anodes may for example consist of graphite, ruthenium-plated titanium, palladium-plated titanium or platinum-plated titanium.

Where a cell consists of several tanks (e.g. installed parallel to each other) as described, the means for blowing gas into the bottom of the containers and for placing and holding the cathodes, the anodes and the anodic boxes in position in precise manner will not need to be modified, but the chlorine collector troughs and the purification sheaths of the tanks would be installed (in the case of a two-parallel-tanks cell) on the left side of the right-hand tank and on the right side of the left-hand tank, whereby common servicing appliances can be used.

What we claim is:

1. A cell for producing metal by electrolyis of aqueous solutions of a chloride of the metal, comprising at least one electrolytic tank having upright cathodes and upright insoluble anodes alternating in the longitudinal direction of the tank each anode being surrounded by an anodic box whose sides which face cathodes each comprise a diaphragm, the cell further comprising means of collecting and recovering the chlorine released during electrolysis, means of drawing off vapour generated at the surface of the electrolyte, means of blowing gas into the bottom of the tank below each cathode, and locating means for use in placing and for retaining in position the cathodes, the anodes and the anodic boxes, said means of collecting and recovering the chlorine comprising a hermetic anodic bell capping each said anodic box and having its lower edges below the electrolyte overflow level, a longitudinally extending trough fixed to the tank and in communication therewith below the electrolyte overflow level, a chlorine collector pipe running along the said trough, feed tube means communicating with the pipe and with the inside of each said anodic bells above the electrolyte overflow level, the collector pipe being connectable to suction means for recovering the chlorine released.

2. A cell as claimed in claim 1, further comprising within the tank a pair of transversely spaced lower longitudinal racks for holding the lower part of the cathodes in position.

3. A cell for producing metal by electrolysis of aqueous solutions of a chloride of the metal, comprising at least one electrolytic tank having upright cathodes and upright insoluble anodes alternating in the longitudinal direction of the tank each anode being surrounded by an anodic box whose sides which face cathodes each comprise a diaphragm, the cell further comprising means of collecting and recovering the chlorine released during electrolysis, means of drawing off vapour generated at the surface of the electrolyte, means of blowing gas into the bottom of the tank below each cathode, and locating means for use in placing and for retaining in position the cathodes, the anodes and the anodic boxes, said means of drawing off vapour generated at the surface of the electrolyte comprising a longitudinally extending purification sheath fixed to the tank and in communication therewith above the electrolysis overflow level, means of drawing off by suction and recovering the contents of the said sheath, and transversely extending flexible strips which co-operate hermetically to cover the tank including said trough and the purification sheath.

4. A cell as claimed in claim 3, further comprising a plurality of at least partially screw-threaded rods secured to the upper part of each said anode, to each said rod there being bolted upwards from below, for each anode, its anodic bell and one of the transversely extending flexible strips, the rods being connected at their upper extremities to a carrying bar common only to all the screw-threaded rods of one anode.

5. A cell as claimed in claim 4, wherein the trough and the purification sheath share a longitudinally extending lateral partition and are fixed to the exterior of the tank, the partition permitting communication between the trough and the sheath but only above the electrolyte overflow level.

6. A cell for producing metal by electrolysis of aqueous solutions of a chloride of the metal, comprising at least one electrolytic tank having upright cathodes and upright insoluble anodes alternating in the longitudinal direction of the tank each anode being surrounded by an anodic box whose sides which face cathodes each comprise a diaphragm, the cell further comprising means of collecting and recovering the chlorine released during electrolysis, means of drawing off vapour generated at the surface of the electrolyte, means of blowing gas into the bottom of the tank below each cathode, and locating means for use in placing and for retaning in position the cathodes, the anodes and the anodic boxes, said means of blowing gas into the bottom of the tank comprising a manyholed distributor vertically below each cathode and having the shape of a shallow vee, each vee being connected at its vertex to a common longitudinal pipe connectable to means of injecting at least one gas under pressure into the pipe.

7. A cell as claimed in claim 6, wherein the holes of the distributors have a diameter of from 0.1 to 0.5 mm.

8. A cell as claimed in claim 7, wherein the holes of each of the distributors are arranged in two rows one at either side of the vertical symmetry plane of the distributor.

9. A cell as claimed in claim 8, wherein each said distributor is of substantially circular section and said rows of holes are circumferentially substantially 90° apart, face generally upwardly and are symmetrical with respect to the vertical.

10. A cell as claimed in claim 6, wherein the distributors are stationarily installed on longitudinal sections removably tethered to longitudinal fins upstanding in the bottom of the tank.

11. A cell for producing metal by electrolysis of aqueous solutions of a chloride of the metal, comprising at least one electrolytic tank having upright cathodes and upright insoluble anodes alternating in the longitudinal direction of the tank each anode being surrounded by an anodic box whose sides which face cathodes each comprise a diaphragm, the cell further comprising means of collecting and recovering the chlorine released during electrolysis, means of drawing off vapour generated at the surface of the electrolyte, means of blowing gas into the bottom of the tank below each cathode, and locating means for use in placing and for retaining in position the cathodes, the anodes and the anodic boxes, said locating means for use in placing and for retaining in position the cathodes, the anodes and the anodic boxes comprising for each anode, a pair of transversely spaced vertically extending guide rails, each guide rail being generally U-shaped in plan, the U being open towards the respective nearer side of the tank and whereof the base of the U has a recess the opposite sides of which clamp the anodic box of the anode in question, the vertical edges of the cathodes being mounted in an electrically insulating edging or frame secured against longitudinal movement by respective limbs of the U of two consecutive guide rails between which is the cathode, said limbs of the U of the guide rails extending vertically above the top of the base of the U and being of inwardly bent configuration to provide sloping guide surfaces for dropping a cathode in place, said locating means further comprising for each anode, two smaller and two larger gripping clamps, all of generally J-shaped profile, the extremity of the longer limb of each J being of outwardly bent configuration for gripping, respectively, the shorter and the longer upper edges of the anodic box of the anode in question, these clamps being fixable to the tank.

12. A cell as claimed in claim 11, wherein the cloth of each anodic box is clamped to the upper edges of the box by means of the said outwardly bent extremity of the longer limb of the J.

13. A cell as claimed in claim 12, wherein the locating means for use in placing and for retaining in position the cathodes, the anodes and the anodic boxes further comprise two laterally spaced and longitudinally extending racks having rectangular teeth whereof the pitch is equal to the distance between two consecutive anodes.

14. A cell as claimed in claim 13, wherein the two smaller gripping clamps of each anodic box are bolted to one of a respective laterally aligned pair of teeth of the racks.

15. A cell as claimed in claim 14 wherein a spacer is interposed between the two smaller gripping clamps of each anodic box and said one of a respective laterally aligned pair of teeth of the racks to which said gripping clamps are bolted.

16. A cell as claimed in claim 14, wherein the transverse extremities of the two larger gripping clamps of each anodic box are produced to extend to be situated in consecutive pairs of aligned crenels of the racks.

17. A cell as claimed in claim 16, wherein the recess in the base of each guide rail has at its upper part a horizontal fastening lug whereon is bolted, between the two limbs of the U of the guide rail, the smaller gripping clamps of the respective anodic box.

18. A cell as claimed in claim 17, wherein the recess in the base of each guide rail has at its lower part a horizontal fastening lug which is bolted on a transverse fastening plate fixed to the bottom of the corresponding anodic box.

19. A cell as claimed in claim 18, wherein the locating means for use in placing and for retaining in position the cathodes, the anodes and the anodic boxes further comprise, in the vertical symmetry plane of each anode, two centering pins upstanding from the tank base, the bottom of the corresponding anodic box having two orifices through which the centering pins pass when the box is in position, and the bottom of the corresponding anode having two blind holes which cap these centering pins when the anode is in position.

20. A cell as claimed in claim 19, wherein the orifices in the bottom of the anodic boxes are each equipped with a sleeve wherein a said centering pin is a sliding fit, the sleeve comprising a flange at its lower extremity and a screw-threaded portion at its upper extremity, over which is threaded a nut which, between the flange of the sleeve and the bottom of the anodic box, grips the lower fastening lug of the guide rails.

* * * * *